US010293346B2

(12) United States Patent
Madsen

(10) Patent No.: US 10,293,346 B2
(45) Date of Patent: May 21, 2019

(54) SCREW CONVEYOR FOR A CENTRIFUGAL SEPARATOR INCLUDING PARTITION WALLS IN THE HELICAL CHANNEL

(71) Applicant: ALFA LAVAL CORPORATE AB, Lund (SE)

(72) Inventor: Bent Madsen, Gentofte (DK)

(73) Assignee: ALFA LAVAL CORPORATE AB, Lund (SE)

( * ) Notice: Subject to any disclaimer, the term of this patent is extended or adjusted under 35 U.S.C. 154(b) by 702 days.

(21) Appl. No.: 14/428,127

(22) PCT Filed: Sep. 12, 2013

(86) PCT No.: PCT/EP2013/068891
§ 371 (c)(1),
(2) Date: Mar. 13, 2015

(87) PCT Pub. No.: WO2014/041061
PCT Pub. Date: Mar. 20, 2014

(65) Prior Publication Data

US 2015/0231647 A1 Aug. 20, 2015

(30) Foreign Application Priority Data

Sep. 14, 2012 (DK) ..... 2012 70567

(51) Int. Cl.
*B04B 1/20* (2006.01)

(52) U.S. Cl.
CPC ..... *B04B 1/20* (2013.01); *B04B 2001/205* (2013.01)

(58) Field of Classification Search
CPC ..... B04B 1/20; B04B 11/00; B04B 11/02; B04B 2001/2083; B04B 2001/2075; B04B 7/08; B04B 2001/205
(Continued)

(56) References Cited

U.S. PATENT DOCUMENTS 2,057,156 A * 10/1936 Lyons ..... B01D 57/02 204/515
4,037,781 A 7/1977 High
(Continued)

FOREIGN PATENT DOCUMENTS

DE 1 295 494 B 5/1969
DE 1 297 034 B 6/1969
(Continued)

OTHER PUBLICATIONS

International Search Report (PCT/ISA/210) dated Jan. 2, 2014, by the European Patent Office as the International Searching Authority for International Application No. PCT/EP2013/068891.
(Continued)

*Primary Examiner* — Charles Cooley
(74) *Attorney, Agent, or Firm* — Birch, Stewart, Kolasch & Birch, LLP

(57) ABSTRACT

A screw conveyor for a centrifugal separator comprises a conveyor hub carrying a helical conveyor flight and providing a helical channel between adjacent turns of helical conveyor flight. The screw conveyor has an up-stream end and a down-stream end. At least two partition walls are arranged in a side-by-side relation to divide at least a radial part of a length of the helical channel into three sub-channels arranged in a side-by-side relation to cause a liquid flowing in the helical channel to flow in an up-stream direction towards the up-stream end in an intermediate sub-channel and in an opposite down-stream direction towards the down-stream end in two adjacent sub-channels on either side of the intermediate sub-channel.

14 Claims, 2 Drawing Sheets

Figure 1:
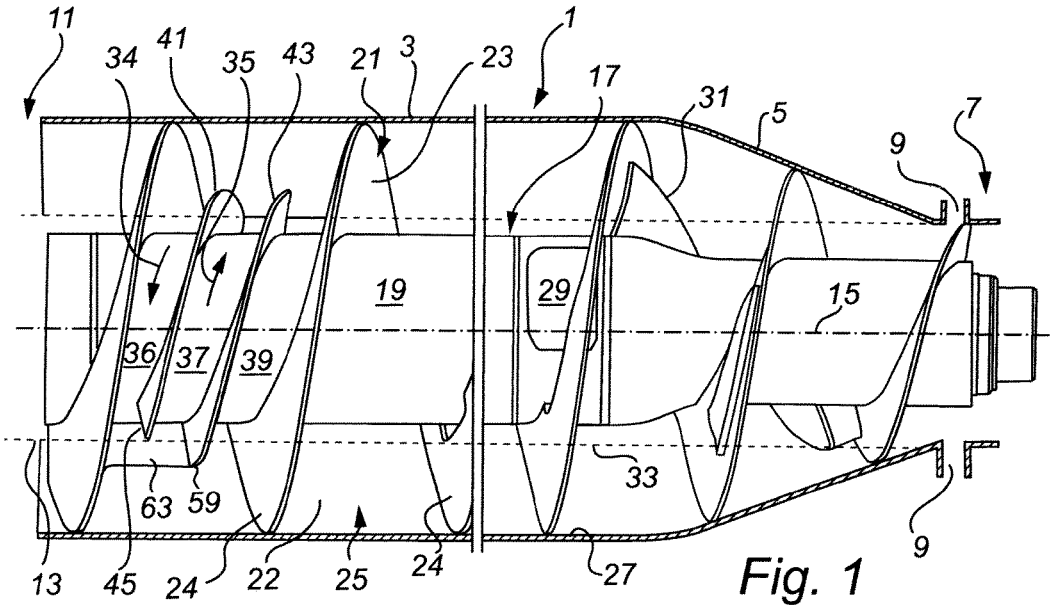

(58) Field of Classification Search
USPC ..... 494/53, 54, 56, 57; 210/380.1, 380.3
See application file for complete search history.

(56) References Cited

U.S. PATENT DOCUMENTS

| | | | | |
|---|---|---|---|---|
| 4,451,247 | A * | 5/1984 | Ostkamp | B04B 1/20 494/52 |
| 4,915,681 | A | 4/1990 | Suzuki | |
| 5,342,281 | A | 8/1994 | Unkelbach et al. | |
| 6,024,686 | A * | 2/2000 | Madsen | B04B 1/20 494/54 |
| 6,749,552 | B1 | 6/2004 | Figgener et al. | |
| 7,549,957 | B2 | 6/2009 | Hruschka et al. | |
| 8,485,959 | B2 * | 7/2013 | Madsen | B04B 1/20 494/53 |
| 9,962,715 | B2 * | 5/2018 | Gronnegaard | B04B 1/20 |
| 2011/0039680 | A1 * | 2/2011 | Madsen | B04B 1/20 494/56 |
| 2015/0231647 | A1 * | 8/2015 | Madsen | B04B 1/20 494/66 |
| 2018/0001329 | A1 * | 1/2018 | Dousset | B04B 1/20 |

FOREIGN PATENT DOCUMENTS

| | | | |
|---|---|---|---|
| DE | 26 51 657 | A1 | 5/1978 |
| DK | 111 110 | B | 6/1968 |
| EP | 1 904 238 | B1 | 9/2011 |
| GB | 456353 | A | 11/1936 |
| JP | 58-043252 | A | 3/1983 |
| JP | 59-169550 | A | 9/1984 |
| WO | WO 2005/084814 | A1 | 9/2005 |
| WO | WO 2006/136171 | A2 | 12/2006 |

OTHER PUBLICATIONS

Danish Search Report dated Apr. 24, 2013 for Application No. PA 2012 70567.

* cited by examiner

SCREW CONVEYOR FOR A CENTRIFUGAL SEPARATOR INCLUDING PARTITION WALLS IN THE HELICAL CHANNEL

The present invention relates to a screw conveyor for a centrifugal separator, especially a decanter centrifuge, for separating at least a first phase and a second phase of a feed material with different densities, comprising a conveyor hub carrying at least one helical conveyor flight and providing at least one helical channel extending between a first and a second channel wall between adjacent turns of helical conveyor flight in a separation space, the screw conveyor rotating in use around an axis of rotation in a direction of rotation, said axis of rotation extending in a longitudinal direction, a radial direction extending perpendicular to the longitudinal direction, the screw conveyor having an up-stream end and a down-stream end; and a feed inlet with at least one feed inlet opening provided in the conveyor hub for letting in feed material into the separation space through the feed inlet opening.

The present invention also relates to a centrifugal separator, especially a decanter centrifuge, for separating at least a first phase and a second phase of a feed material with different densities said centrifugal separator comprising: a bowl rotating in use around an axis of rotation in a direction of rotation, said axis of rotation extending in a longitudinal direction of said bowl, a radial direction extending perpendicular to the longitudinal direction; a heavy phase outlet provided at a front end of the bowl for letting out a heavy phase of the feed material; a liquid outlet provided at rear end of the bowl for letting out a light liquid phase of the feed material; a screw conveyor accommodated in the bowl, said screw conveyor having an up-stream end at the front end of the bowl and a down-stream end at the rear end of the bowl, the screw conveyor rotating in use around the axis of rotation in the direction of rotation at a different rotational speed than the bowl.

During use of a centrifugal separator of the above art a pond of feed material is provided as a coaxial annular body in the separation space, which is provided between an inner wall of the bowl and the conveyor hub.

A centrifugal separator comprising a screw conveyor of the above mentioned art is known from e.g. U.S. Pat. No. 7,549,957, which discloses a screw conveyor with a helical conveyor flight comprising several turns, a feed inlet opening bridging a space between three turns, and a single auxiliary screw blade extending from a body of the screw conveyor to a smaller radial distance from the axis of rotation than the helical conveyor flights, whereby the feed inlet opening is closed between the auxiliary screw blade and the adjacent turn of helical conveyor flight. This allows light material in the separation space to pass the feed inlet opening without being disturbed by feed inlet from the inlet opening.

EP-B-1 904 238 discloses another centrifugal separator comprising a screw conveyor with helical conveyor flight and an additional conveyor flight extending through a major part of the separation space to a radial distance from the axis of rotation equal to that of the helical conveyor flight. The two flights are interconnected at the end of the bowl comprising the liquid outlet whereby two adjacent helical channels are provided in said major part of the separation space a first one of said adjacent channels being closed at its end at the liquid outlet the second of the adjacent channels being open. The feed inlet opening is provided at the closed end of the first of the adjacent channels and thus liquid feed is forced to flow from the feed inlet opening through the first of the adjacent channels towards the heavy phase outlet to the end of the additional conveyor flight and return through the second of the adjacent channels to the liquid outlet. Thus disturbance of separated phases or substances by the feed inlet is reduced.

U.S. Pat. No. 6,749,552 discloses a decanter centrifuge in which a baffle plate formed as a ring plate without openings is provided on the screw conveyor between the feed inlet openings and the liquid outlet. This arrangement prevents e.g. foam floating in the upper surface layers of the pond from reaching the liquid outlet. This effect may in some cases be attractive and in other cases not.

It is an object of the present invention to provide for enhanced freedom of design to provide for tailoring a screw conveyor to a given process.

This is obtained in that said screw conveyor comprises at least two partition walls arranged in a side-by-side relation to divide at least a radial part of a length of said at least one helical channel into three sub-channels arranged in a side-by-side relation to cause a liquid flowing in the at least one helical channel to flow in an up-stream direction towards the up-stream end in an intermediate sub-channel and in an opposite down-stream direction towards the down-stream end in two adjacent sub-channels on either side of the intermediate sub-channel. By arranging two partition walls in a side-by-side relationship instead of a single partition wall like the above mentioned single auxiliary screw blade and additional conveyor flight an enhanced freedom of design is provided for with the benefit that tailoring or adapting the design of a screw conveyor to a given process is made easier since the invention provides a tool for influencing through the design the flow of liquid inside a centrifugal separator.

The invention may be applied to centrifugal separators with a horizontal axis of rotation as well as centrifugal separators with a vertical axis of rotation.

Centrifugal separators are generally known to be used to separate different substances or phases of a feed material. The number of substances may be two or more, e.g. a heavy phase of solids and one or two phases of liquids having different densities. The present invention is applicable to centrifugal separators for separating two or more phases of a feed material.

In an embodiment wherein adjacent turns of the at least one helical conveyor flight at least on average extends to a first radial distance measured from the axis of rotation and the at least two partition walls between said adjacent turns at least on average extend to a second radial distance measured from the axis of rotation, the second radial distance is smaller than the first radial distance. Hereby is obtained that the at least two partition walls may affect layers of the pond of feed material closest to the axis of rotation whereas layers of the pond more remote from said axis, e.g. a heavy phase of feed material being conveyed towards the heavy phase outlet by the helical conveyor flight, may substantially not be affected.

In an embodiment, wherein the screw conveyor is a trailing screw conveyor, the three sub-channels are arranged in a stream-wise succession. Since the three sub-channels are in this embodiment arranged in stream-wise succession liquid that is flowing in the down-stream direction into one of the adjacent sub-channels will flow from that sub-channel into the intermediate sub-channel to flow therethrough in the (overall) up-stream direction and from the intermediate channel flow through the other of the adjacent channels in the down-stream direction. Thus liquid will pass the sub-channels from a position up-stream of the sub-channels to a position down-stream of the sub-channels.

It is noted that a trailing screw conveyor is a screw conveyor rotating in use at a rotational speed a little lower than the rotational speed of the bowl. Correspondingly a leading screw conveyor is a screw conveyor rotating in use at a rotational speed a little higher than the rotational speed of the bowl.

When feed material enters a centrifugal separator through a feed inlet opening in the conveyor hub the feed material will often not have been accelerated to the rotational speed of the bowl or conveyor at the time the feed material reaches the pond, therefore the feed material will initially flow rearwards relative to the rotating bowl and pond through the helical channel provided by helical conveyor flight. For a centrifugal separator with a trailing screw conveyor this rearwards flow is in the down-stream direction towards the liquid outlet which thus may be reached relatively soon by the feed material. Further the feed material flowing rearwards has a lower rotational speed than the bowl and thus separation of substances or phases of the feed material having different densities is less efficient than intended due to the centrifugal forces being smaller on account of the lower rotational speed. These problems are reduced by the latter embodiment i.a. due to the fact that the feed material flowing in the up-stream direction in the intermediate sub-channel has a higher rotational speed than the bowl and thus the effect of separation of substances or phases is enhanced in this sub-channel.

In a further practical embodiment a first partition wall of said two partition walls extends from a first free end of the first partition wall at a first helical position in the at least one helical channel along the first channel wall to a second end of the first partition wall at an up-stream helical position up-stream of the first helical position, the first partition wall being at its second end connected to the second channel wall, and a second partition wall of said two partition walls extends from a first free end of the second partition wall at a second helical position in the at least one helical channel up-stream of the first helical position along the second channel wall to a second end of the second partition wall at a down-stream helical position down-stream of the second helical position, the second partition wall being at its second end connected to the first channel wall, thereby providing said three sub-channels as a first sub-channel between the first channel wall and the first partition wall; a second sub-channel, the intermediate sub-channel, between said two partition walls; and a third sub-channel between the second partition wall and the second channel wall.

In a further embodiment the at least one feed inlet opening is positioned up-stream of the first helical position relative to said stream-wise succession. Hereby is obtained that feed that has entered the separation space and flows in the layers of the pond closest to the axis of rotation will flow down-stream through at least a part of the first sub-channel, thereafter up-stream through the second or intermediate sub-channel and finally down-stream through the third sub-channel.

In a further embodiment the at least one feed inlet opening is positioned up-stream of the partition walls in the at least one helical channel.

In a different embodiment, wherein the screw conveyor is a leading screw conveyor, said two partition walls have respectively a first down-stream end and a free second up-stream end, the down-stream ends of the respective partition walls being interconnected thus providing the intermediate sub-channel as a dead-end sub-channel between two open-ended sub-channels, the at least one feed inlet opening being positioned in the dead-end intermediate sub-channel. Hereby is obtained that feed material entering the dead-end intermediate sub-channel or at least a light liquid phase thereof will flow up-stream out of that sub-channel and enter either of the adjacent sub-channels to flow down-stream towards the liquid outlet. The provision of two adjacent sub-channels provides for enhanced freedom of design to provide for tailoring a screw conveyor to a given process.

In a further embodiment the at least one feed inlet opening is positioned at the interconnected first down-stream ends of the partition walls.

Generally in a further embodiment applicable to both trailing and leading screw conveyors at least one of the first and the second channel wall is constituted by the at least one helical conveyor flight.

It should be understood that herein the expression "level" refers to the radial distance from the axis of rotation, and by analogy to the field of gravity of earth "up" refers to a direction towards the axis of rotation and "down" refers to an opposite direction.

Figure 2:
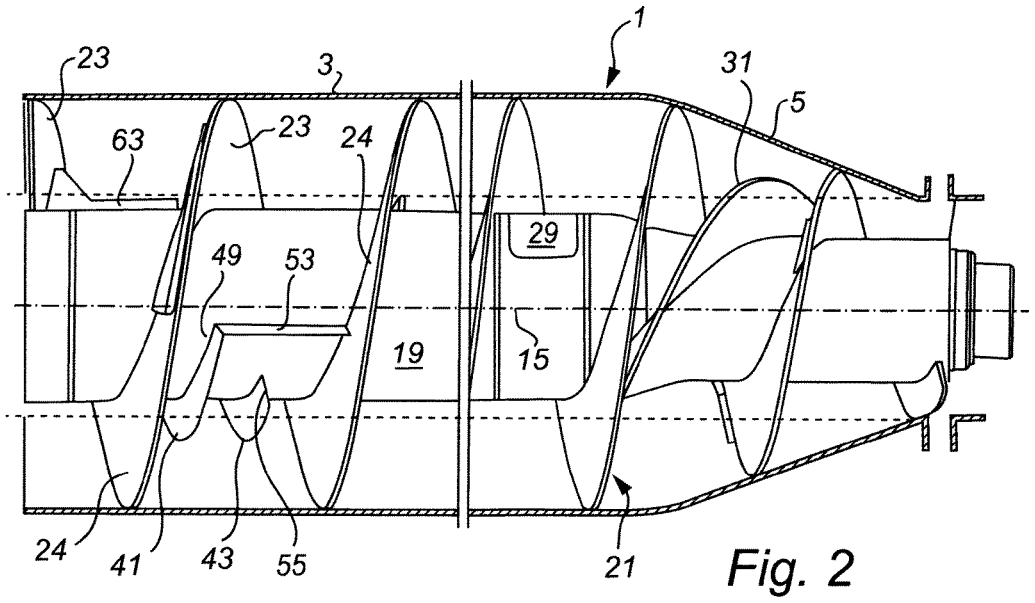
Figure 3:
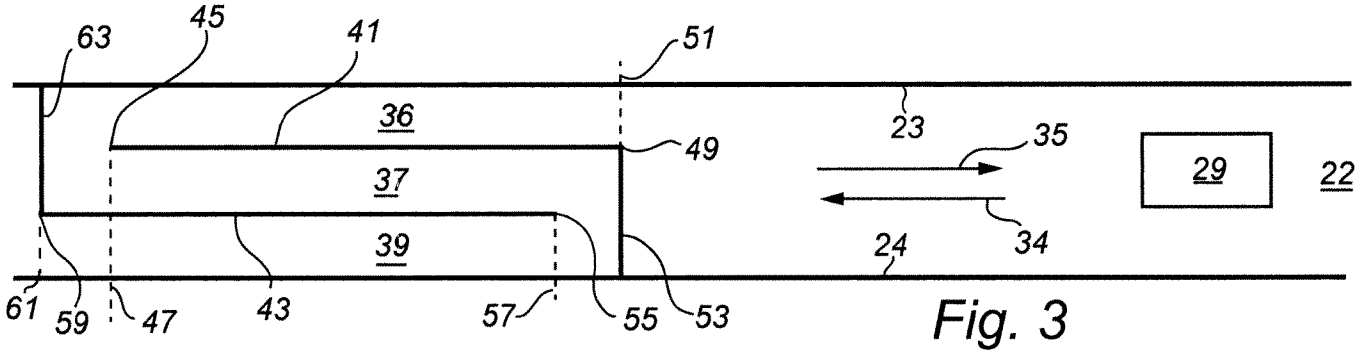
Figure 4:
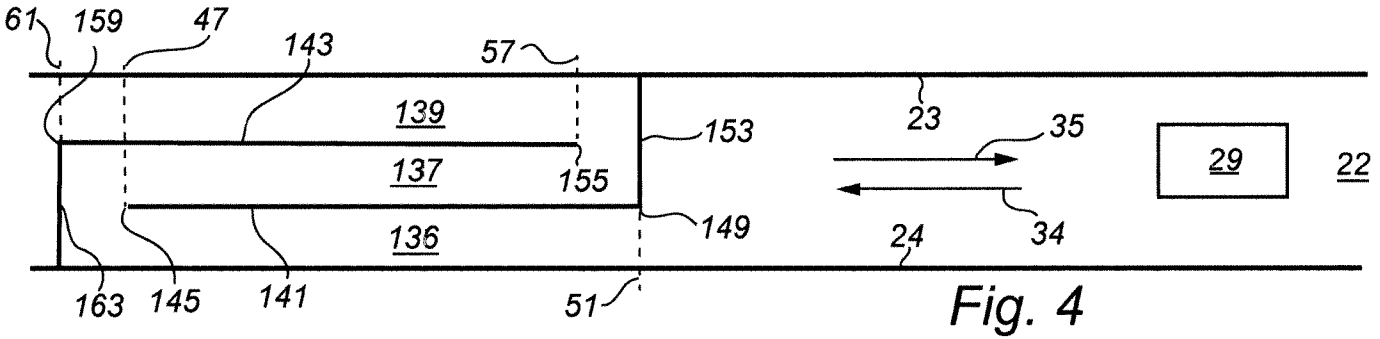

In the following the invention will be explained in further detail by means of examples of embodiments having reference to the accompanying schematic drawings, in which FIG. 1 shows the bowl and screw conveyor of a decanter centrifuge in a first embodiment of the present invention, FIG. 2 shows the decanter centrifuge of FIG. 1 with the screw conveyor rotated approximately 140°, FIG. 3 shows a developed view of the helical channel of the screw conveyor of FIGS. 1 and 2, FIG. 4 shows a developed view of the helical channel in a variant of the embodiment of FIGS. 1-3, and FIG. 5 shows a developed view of the helical channel of another embodiment of the invention.

FIGS. 1 and 2 show a bowl 1 of a decanter centrifuge in a first embodiment of the present invention, said bowl 1 having cylindrical part 3 and a conical part 5. At a front end or up-stream end 7 of the bowl 1 heavy phase outlet openings 9 are providing an outlet for a heavy phase of a feed material. At a rear end or down-stream end 11 of the bowl 1 a liquid outlet 13 is provided for letting out a light liquid phase of the feed material. In use the bowl is rotating around an axis 15 of rotation, which is coincident with a longitudinal axis of the bowl. In the present embodiment the axis 15 of rotation is horizontal.

Inside the bowl 1 a screw conveyor 17 is accommodated and in use the screw conveyor 17 is rotating around the axis 15 of rotation in the same direction as the bowl 1, but at a slightly lower rotational speed. The screw conveyor 17 comprises a conveyor hub 19 carrying a helical conveyor flight 21. Between the turns of the helical conveyor flight 21 a helical channel 22 is provided. The helical channel 22 is delimited by a first channel wall 23 and a second channel wall 24, which in the present embodiment are provided by opposite sides of the helical conveyor flight 21. In the conveyor hub 19 a feed inlet is provided for letting a feed material into a separation space 25 provided between an inner wall 27 of the bowl 1 and the conveyor hub 19. The feed inlet comprises two feed inlet openings 29 through which the feed material is let into the separation space 25 during operation of the decanter centrifuge.

In the embodiment shown the screw conveyor 17 comprises a helical baffle 31 as disclosed in U.S. Pat. No. 6,024,686 incorporated herein by reference. This helical baffle 31 is however not part of the present invention.

In FIGS. 1 and 2 an intermediate part of the bowl 1 and the screw conveyor 17 have been omitted to provide a more clear view of the ends of the bowl 1 and the screw conveyor 17.

During operation of the decanter centrifuge a feed material is fed into the separation space 25 through the feed inlet openings 29. In the separation space 25 the feed material forms an annular pond with an upper surface 33. At the bottom of the pond i.e. at the inner wall 27 of the bowl a heavy phase of the feed material is concentrated due to the centrifugal force provided by the rotation of the bowl and at the upper surface 33 a light liquid phase of the feed material is concentrated. The light liquid phase flows to the liquid outlet 13 in a down-stream direction 34, whereas the heavy phase is conveyed towards the heavy phase outlet openings 9 by the helical conveyor flight 21 in an opposite or up-stream direction 35. The arrangement of the liquid outlet 13 determines the level of the upper surface 33 of the pond as it is known in the art.

In the present embodiment of the invention wherein the screw conveyor in use is rotating at a slightly lower speed than the bowl, i.e. it is a so-called trailing screw conveyor, feed material, which emerges from the feed inlet openings 29 and has a lower rotational speed than that of the bowl and the feed material already in the pond, will accordingly initially flow in a layer at the surface of the pond through the helical channel 22 towards the rear end 11 of the bowl.

According to the present invention a part of the helical channel 22 is divided into a first, a second or intermediate, and a third sub-channel 36, 37, and 39 as seen in FIGS. 1, 2 and 3. Thus a first and a second partition wall 41 and 43 are carried by the conveyor hub 19. The first partition wall 41 has a first free end 45 at a first helical position 47, i.e. a first position along the helical channel 22, and extends therefrom along the first channel wall 23 to a second end 49 of the first partition wall 41 at an up-stream helical position 51 up-stream of the first helical position 47. The first partition wall 41 is at its second end 49 connected to the second channel wall 24 through first cross wall 53. The first cross wall 53 does not contact the first channel wall 23, which is an upstream helical partition. Therefore, the first partition wall 41 and first cross wall 53 from a first partition extending into the helical channel from the second channel wall 24. The second partition wall 43 has a first free end 55 at a second helical position 57, i.e. a second position along the helical channel 22, up-stream of the first helical position 47, and the second partition wall 43 extends from its free end 55 along the second channel wall 24 to a second end 59 of the second partition wall 43 at a down-stream helical position 61 down-stream of the second helical position 55. The second partition wall 43 is at its second end 59 connected to the first channel wall 23 through a second cross wall 63. The second cross wall does not contact the second channel wall 24, which is a downstream helical partition Therefore, the second partition wall 43 and second cross wall 63 form a second partition extending into the helical channel from the first channel wall 23. Since the first and the second partition wall 41 and 43 extend side-by-side between the first helical position 47 and the second helical position 57 and since the first and the second partition wall 41 and 43 are connected through the first and the second cross wall 53 and 63 to the first and the second channel wall 23 and 24, respectively, a labyrinth is provided comprising the first sub-channel 36 between the first channel wall 23 and the first partition wall 41; the second or intermediate sub-channel 37 between the two partition walls 41, 43; and the third sub-channel 39 between the second partition wall 43 and the second channel wall 24. Thus the first, the second and the third sub-channel are provided in a stream-wise succession since material flowing at the upper surface 33 of the pond from a position up-stream of the two partition walls 41, 43 must enter the first sub-channel 36 at the up-stream helical position 51 and flow in the down-stream direction 34 through the first sub-channel 36 to the first free end 45 of the first partition wall 41, around said first free end 45 and through the second sub-channel 37 in the up-stream direction 35 to the first free end 55 of the second partition wall 43, around said free 55 end and through the third sub-channel 39 in the down-stream direction 34 to leave the labyrinth at the down-stream helical position 61.

As seen in FIGS. 1 and 2 the helical conveyor flight 21 extends to a radial distance from the axis 15 of rotation close to that of the inner wall 27 of the bowl 1, whereas the two partition walls 41 and 43 and the two cross walls 53 and 63 extend to a smaller radial distance. Thereby the labyrinth provided by the two partition walls 41 and 43 and the two cross walls 53 and 63 extends into the upper layers of the pond while in the deeper layers of the pond adjacent the inner wall 27 of the bowl the heavy phase of the feed material that is gathered there may be conveyed in the up-stream direction 35 by the helical conveyor flight 21 below the labyrinth. Thus the two partition walls 41 and 43 and the two cross walls 53 and 63, and therewith the three sub-channels 36, 37, 39, extend through an upper radial part or the helical channel 22. Further the three sub-channels 36, 37, 39 extend through only a limited length of the helical channel 22 that is in the present embodiment the length between the up-stream helical position 51 and the down-stream helical position 61.

As further seen in FIGS. 1, 2 and 3 in the present embodiment the two partition walls 41 and 43 extend helically between the first and the second channel wall 23 and 24. Further in the present embodiment the two partition walls 41 and 43 extend equidistantly relative to the adjacent channel wall 23 and 24, respectively, and to each other.

In the embodiment shown in FIGS. 1, 2 and 3 the feed inlet openings 29 are placed up-stream of the labyrinth provided by the three sub-channels 36, 37, 39. The feed inlet openings 29 might be positioned down-stream relative to what is shown, but they should preferably be placed up-stream of the first free end 45 of the first partition wall 41.

FIG. 4 shows a variant of the embodiment disclosed in FIGS. 1 to 3. Like features are given like reference numerals and like but rearranged features are given like reference numerals with the addition of a prefix "1". It is noted that the labyrinth provided by the sub-channels 36, 37, 39 is simply mirror-inverted and the functions of the two variants of FIGS. 1-3 and FIG. 4 are similar.

When feed material is emerging from the feed inlet openings 29 and is having a lower rotational speed than that of the bowl and the conveyor, whereby the newly fed material initially flow in a layer at the surface of the pond through the helical channel 22 towards the rear end 11 of the bowl, the lower rotational speed entails lower centrifugal forces acting on the newly fed material which again entails less separation of heavy and light phases of the feed material since it is the centrifugal forces that entails the separation. This problem is overcome by the feed material flowing in the upper layers of the pond being forced to flow in the up-stream direction through the second, intermediate sub-channel 37, 137 which entails a higher rotational speed than that of the conveyor 17, and thus higher centrifugal forces will be acting on feed material flowing in the up-stream direction 35 through the second sub-channel 37, 137.

Figure 5:
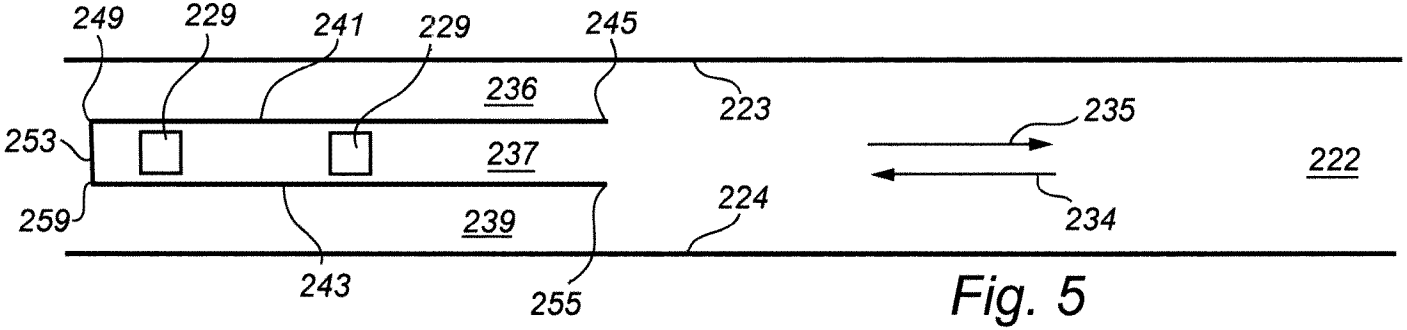

FIG. 5 shows in a developed view another embodiment suited for a centrifugal separator, such as a decanter centrifuge, with a leading screw conveyor, i.e. a screw conveyor that during operation is rotating at a slightly higher speed than the bowl. Thus FIG. 5 shows a helical channel 222 extending between two channel walls 223, 224, which might be constituted by opposite sides of a helical conveyor flight similar to the helical conveyor flight 21. Like for the embodiment of FIGS. 1 to 3 in the embodiment of FIG. 5 a heavy phase outlet is found in an up-stream direction 235 and a liquid outlet is found in a down-stream direction 234. Generally a decanter centrifuge accommodating a screw conveyor as indicated in FIG. 5 might be constructed similar to the embodiment of FIGS. 1 to 3 apart from the configuration of the partition walls and cross walls and apart from the fact that having a leading screw conveyor, the bowl accommodating the screw conveyor indicated in FIG. 5 is either rotating in the opposite direction compared the FIGS. 1 to 3 embodiment, or the helical conveyor flight is formed as a right-hand screw rather than a left-hand screw like the helical conveyor flight 21.

In the helical channel 222 two partition walls 241, 243 are provided side-by-side each extending from a first down-stream end 249, 259 to a free second up-stream end 245, 255, respectively. At their first down-stream ends 249, 259 the two partition walls 241, 243 are interconnected by a cross wall 253 thus providing a dead-end intermediate sub-channel 237 between the two partition walls 241, 243. Between either of the two partition walls 241, 243 and the adjacent channel wall 223, 224, respectively, an open-ended sub-channel 236, 239 is provided. Feed inlet openings 229 are positioned to inlet feed material into the intermediate sub-channel 237.

During operation of the embodiment of FIG. 5 the newly fed material emerging from the feed inlet openings 229 will initially flow in the upper layer of the pond in the up-stream direction 235 due to a lower rotational speed. This is opposite to the situation explained in relation to the embodiment of FIGS. 1 to 3 because of the leading rather than trailing screw conveyor.

Having left the dead-end intermediate sub-channel 237 at least the light liquid phase of the newly fed material will reverse its direction of flow to approach the liquid outlet found in the down-stream direction 234. Thus the light liquid phase will flow through the two open-ended sub-channels 236, 239 in the down-stream direction 234.

In the embodiment shown in FIG. 5 the two partition walls 241 and 243 extend equidistantly relative to the adjacent channel wall 223 and 224, respectively, and to each other. However due to the fact that two partitions walls 241, 243 are used it is possible to construct the screw conveyor with the partition walls 241, 243 shifted laterally in the helical channel 222 to alter the amount of flow through the three sub-channels. Thus the provision of two partitions walls 241, 243 provides a freedom of design for tailoring a screw conveyor to a given process.

The invention is not limited to the embodiments described above. A large number of variations and amendments are possible within the scope of the attached claims.

The invention claimed is:

1. A screw conveyor for a centrifugal separator for separating at least a first phase and a second phase of a feed material with different densities, comprising:

a conveyor hub carrying a helical conveyor flight and providing at least one helical channel extending between a first upstream channel wall of said helical conveyor flight and a second downstream channel wall of said helical conveyor flight, the at least one helical channel disposed between adjacent turns of helical conveyor flight in a separation space, the screw conveyor having an upstream end and a downstream end and an axis of rotation;

a feed inlet with at least one feed inlet opening provided in the conveyor hub for letting in feed material into the separation space;

a first upstream helical partition wall and a second downstream helical partition wall;

a first cross wall extending in an axial direction between the first upstream channel wall and the second downstream helical partition wall; and a second cross wall extending in the axial direction between the second downstream channel wall and the first upstream helical partition wall, wherein the first cross wall does not contact the first upstream helical partition wall and the second cross wall does not contact the second downstream helical partition wall.

2. A screw conveyor according to claim 1, wherein adjacent turns of the helical conveyor flight at least on average extends to a first radial distance measured from the axis of rotation and the at least two partition walls between said adjacent turns at least on average extend to a second radial distance measured from the axis of rotation, the second radial distance being smaller than the first radial distance.

3. A screw conveyor according to claim 2, wherein the screw conveyor is a trailing screw conveyor, and wherein the first upstream helical partition wall and the second downstream helical partition wall form three sub-channels between the first upstream channel wall and the second downstream channel wall, wherein the three sub-channels are arranged in a stream-wise succession.

4. A screw conveyor according to claim 3, wherein a first partition wall of said two partition walls extends from a first free end of the first partition wall at a first helical position in the at least one helical channel along the first channel wall to a second end of the first partition wall at an upstream helical position upstream of the first helical position, the first partition wall being at its second end connected to the second channel wall, and a second partition wall of said two partition walls extends from a first free end of the second partition wall at a second helical position in the at least one helical channel upstream of the first helical position along the second channel wall to a second end of the second partition wall at a downstream helical position downstream of the second helical position, the second partition wall being at its second end connected to the first channel wall, thereby providing said three sub-channels as a first sub-channel between the first channel wall and the first partition wall;

a second sub-channel, the intermediate sub-channel, between said two partition walls; and a third sub-channel between the second partition wall and the second channel wall.

5. A screw conveyor according to claim 4, wherein the at least one feed inlet opening is positioned upstream of the first helical position relative to said stream-wise succession.

6. A screw conveyor according to claim 5, wherein the at least one feed inlet opening is positioned upstream of the partition walls in the at least one helical channel.

7. A centrifugal separator for separating at least a first phase and a second phase of a feed material with different densities said centrifugal separator comprising:

a bowl rotating in use around an axis of rotation;

a heavy phase outlet provided at a front end of the bowl for letting out a heavy phase of the feed material;

a liquid outlet provided at rear end of the bowl for letting out a light liquid phase of the feed material;

a screw conveyor accommodated in the bowl, said screw conveyor having an upstream end at the front end of the bowl and a downstream end at the rear end of the bowl, the screw conveyor rotating in use around the axis of rotation in the direction of rotation at a different rotational speed than the bowl, wherein the screw conveyor is the screw conveyor according to claim 4.

8. A screw conveyor according to claim 1, wherein the screw conveyor is a leading screw conveyor, said two partition walls having respectively a first downstream end and a free second upstream end, the downstream ends of the respective partition walls being interconnected thus providing the intermediate sub-channel as a dead-end sub-channel between two open-ended sub-channels, the at least one feed inlet opening being positioned to let feed material into the intermediate sub-channel.

9. A screw conveyor according to claim 8, wherein the at least one feed inlet opening is positioned at the interconnected first downstream ends of the partition walls.

10. The screw conveyor according to claim 8, wherein adjacent turns of the helical conveyor flight at least on average extends to a first radial distance measured from the axis of rotation and the partition walls between said adjacent turns at least on average extend to a second radial distance measured from the axis of rotation, the second radial distance being smaller than the first radial distance.

11. A centrifugal separator for separating at least a first phase and a second phase of a feed material with different densities said centrifugal separator comprising:

a bowl rotating in use around an axis of rotation;

a heavy phase outlet provided at a front end of the bowl for letting out a heavy phase of the feed material;

a liquid outlet provided at rear end of the bowl for letting out a light liquid phase of the feed material;

a screw conveyor accommodated in the bowl, said screw conveyor having an upstream end at the front end of the bowl and a downstream end at the rear end of the bowl, the screw conveyor rotating in use around the axis of rotation in the direction of rotation at a different rotational speed than the bowl, wherein the screw conveyor is the screw conveyor according to claim 8.

12. A centrifugal separator for separating at least a first phase and a second phase of a feed material with different densities said centrifugal separator comprising:

a bowl rotating in use around an axis of rotation a heavy phase outlet provided at a front end of the bowl for letting out a heavy phase of the feed material;

a liquid outlet provided at rear end of the bowl for letting out a light liquid phase of the feed material;

a screw conveyor accommodated in the bowl, said screw conveyor having an upstream end at the front end of the bowl and a downstream end at the rear end of the bowl, the screw conveyor rotating in use around the axis of rotation in the direction of rotation at a different rotational speed than the bowl, wherein the screw conveyor is the screw conveyor according to claim 1.

13. The centrifugal separator according to claim 12, wherein the centrifugal separator is a decanter centrifuge.

14. The screw conveyor according to claim 1, wherein the screw conveyor is used in a decanter centrifuge.

* * * * *